US006848804B2

(12) United States Patent
Webber

(10) Patent No.: US 6,848,804 B2
(45) Date of Patent: Feb. 1, 2005

(54) HEAD-MOUNTED LIGHT

(76) Inventor: Ray T. Webber, 6751 Boston State Rd., Hamburg, NY (US) 14075

( * ) Notice: Subject to any disclaimer, the term of this patent is extended or adjusted under 35 U.S.C. 154(b) by 0 days.

(21) Appl. No.: 10/610,209

(22) Filed: Jun. 30, 2003

(65) Prior Publication Data

US 2004/0264177 A1 Dec. 30, 2004

(51) Int. Cl.[7] ..... F21V 21/084
(52) U.S. Cl. ..... 362/105; 362/106
(58) Field of Search ..... 362/103, 105, 362/106; 2/200.2, 209.13, 906

(56) References Cited

U.S. PATENT DOCUMENTS 3,087,049 A * 4/1963 Schecter ..... 362/105
3,683,168 A 8/1972 Tatie
3,912,919 A 10/1975 Eriksson
4,916,596 A 4/1990 Sharrah et al.
5,163,420 A 11/1992 Van Der Bel
5,853,241 A 12/1998 Sharrah et al.
5,898,472 A 4/1999 Oshikawa
6,575,588 B2 * 6/2003 Strehl ..... 362/105

* cited by examiner

*Primary Examiner*—Y. My Quach-Lee
(74) *Attorney, Agent, or Firm*—James C. Simmons

(57) ABSTRACT

A light apparatus attachable to the head of a person to emit light generally along the line of sight of the person. The light apparatus including a housing cavity in which are contained a light bulb and a pair of batteries on opposite sides thereof and connected thereto. At least a portion of the housing is composed of elastomeric material having a rear concave surface shaped for conforming to a person's forehead to allow elastomeric conformity of the rear surface to the person's forehead. The light bulb and a lens are disposed for directing light forwardly of the housing and generally along the line of sight of the person. A plurality of legs on at least one side of the housing provide support for setting the light apparatus down.

10 Claims, 3 Drawing Sheets

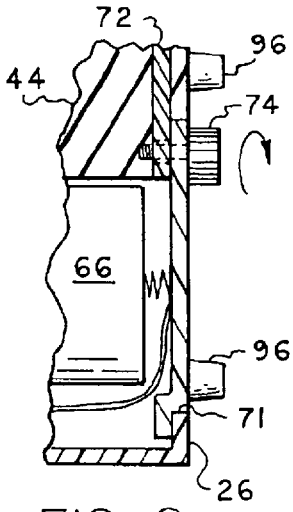
FIG. 8
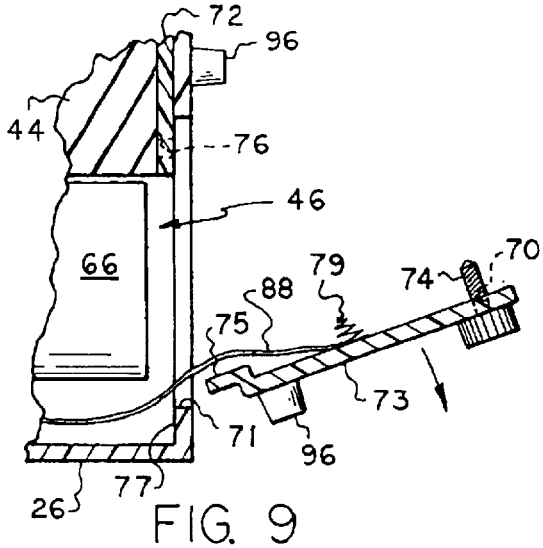
FIG. 9
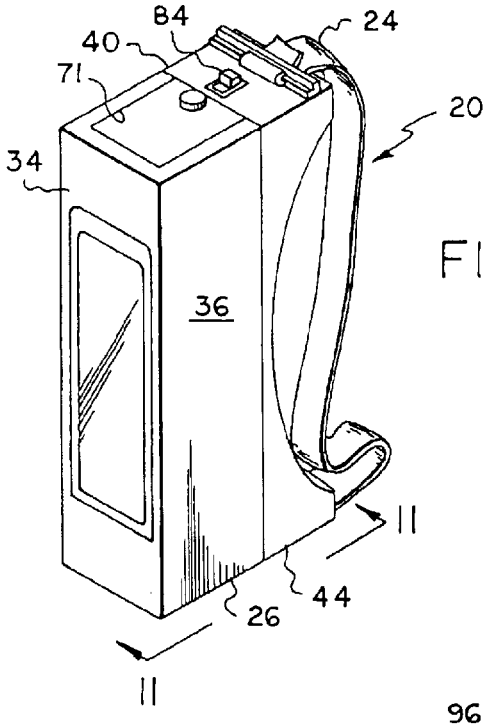
FIG. 10
FIG. 11
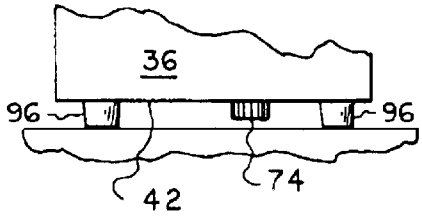

HEAD-MOUNTED LIGHT

The present invention relates generally to lights or lamps, i.e., illuminating apparatus. More particularly, the present invention relates to lights which are attachable to a person's head to free the person's hands for the work at hand.

A number of attempts have been made to provide a light attachable to a person's head. Thus, U.S. Pat. No. 3,683,168 to Tatje discloses illuminating spectacles having a light bulb with batteries on opposite sides of the bulb. Undesirably, the spectacles and their placement on a person's head are not able to suitably support the weight of the lamp components.

U.S. Pat. No. 3,912,919 to Eriksson discloses a head lamp comprising a bulb and batteries (one mounted on either side of a glow lamp holder) mounted in a casing, and a strap is extractable from the lid interior to be extended about a person's head so that the light is disposed centrally of the person's forehead. Undesirably, this lamp fixture is unstable on the person's forehead and places undue stress at the center of the person's forehead. In addition, this lamp is undesirably difficult to position for proper aim and to maintain in the adjusted position.

U.S. Pat. No. 5,853,241 to Sharrah et al discloses a flashlight having a head portion in which the light bulb is received and a pair of arms in which batteries are received and which diverge from the head portion for mounting of the head portion on the forehead of a user by means of an elastic strap. The arms are provided with resilient removable cover members to provide a resilient head mounting surface. See also U.S. Pat. No. 4,916,596 to Sharrah et al, which discloses an earlier version. This flashlight undesirably is difficult to position and to maintain the position for proper aim in view of the rigid arms.

U.S. Pat. No. 5,163,420 to Van Der Bel discloses a head light system which includes a housing mounted on the front surface of a head cap 11. A fiber optic light conduit introduces light from a remote light source to the housing. The housing is mounted on the front surface of a head cap. The rear surface of the housing, which is the surface which is next to the forehead, is concave. The provision of a remote fiber optic light source is undesirably not suitable for the general utility purposes of the present invention.

Also see U.S. Pat. No. 5,898,472 to Oshikawa, which discloses a strap winding mechanism and reel for head wear.

The heretofore problem with mounting of traditional sources of light such as incandescent bulbs is addressed in the third paragraph of the Van Der Bel patent as follows:

> Traditional sources of light, however, such as incandescent bulbs, do not lend themselves well to positioning at approximately between the surgeon's eyes. Such traditional light sources had the problem that, if they were large enough to provide sufficient light, they were too bulky and obscured the surgeon's vision. Furthermore, they were frequently heavy and they also generated a great deal of heat . . . .

It is accordingly an object of the present invention to provide a traditional light source (i.e., a light bulb and batteries) which may be easily and comfortably worn on a person's head and easily positioned for proper aim to free the user's hands when working in darkened conditions.

In order to provide such a head light, in accordance with the present invention, a housing for the light bulb and batteries has at least a portion composed of elastomeric material having a rear concave surface shaped for conforming to a person's forehead to allow elastomeric conformity of the rear surface to the person's forehead.

The above and other objects, features, and advantages of the present invention will be apparent in the following detailed description of a preferred embodiment thereof when read in conjunction with the accompanying drawings wherein the same reference numerals denote the same or similar parts throughout the several views.

BRIEF DESCRIPTION OF THE DRAWINGS

FIG. 8 is a detail partial section view along the left side thereof.

FIG. 9 is a view similar to that of FIG. 8 illustrating removal of a housing member for replacement of a battery.

FIG. 10 is a perspective view thereof shown standing on its left side.

FIG. 11 is a partial elevational view taken along lines 11—11 of FIG. 10.

DETAILED DESCRIPTION OF THE PREFERRED EMBODIMENT

Figure 1:
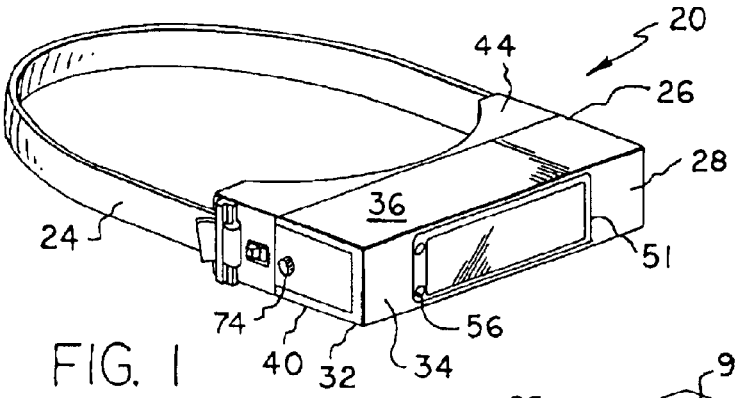
FIG. 1 is a perspective view from forwardly thereof of a head-mountable light in accordance with the present invention.
Figure 2:
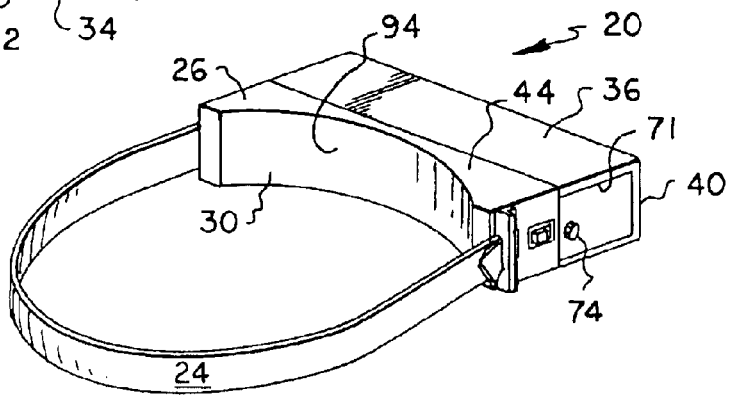
FIG. 2 is a perspective view thereof from forwardly thereof.
Figure 3:
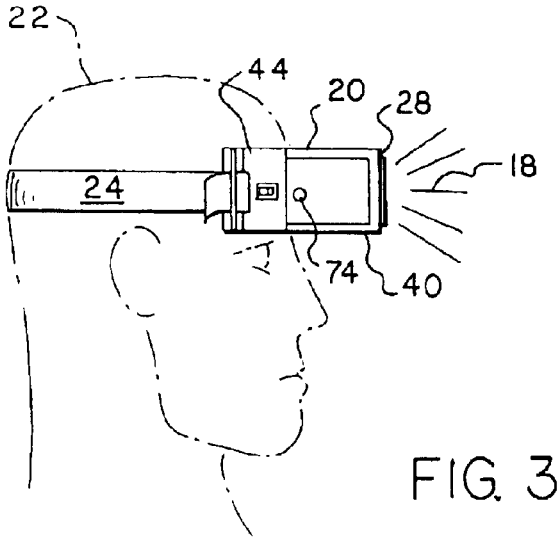
FIG. 3 is a side view thereof shown mounted to a person's head.
Figure 4:
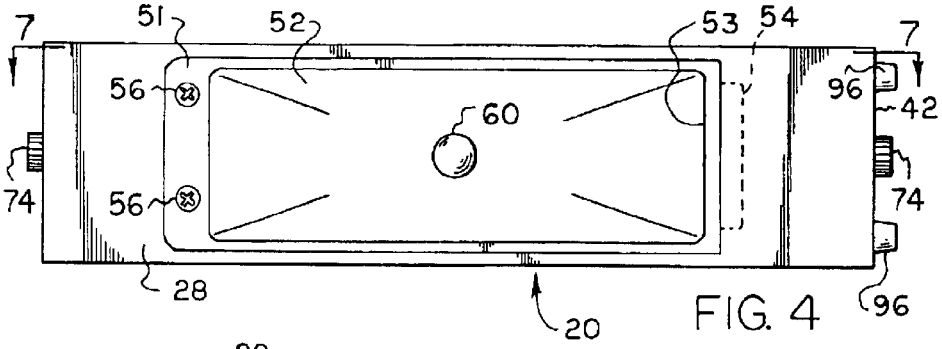
FIG. 4 is a front elevation view thereof.
Figure 5:
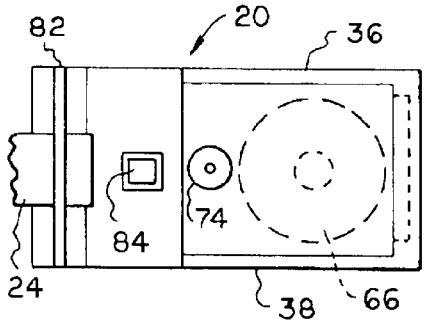
FIG. 5 is a right side elevation view thereof, with a strap broken away.

Referring to the drawings, there is shown generally at 20 a light or lamp which emits light, illustrated at 18, and which is mountable to the head 22 of a person, as illustrated in FIG. 3, by means of a strap 24 or other suitable attachment means which encircles the head 22. If desired, the strap 24 may be of a retractable type or with a winding mechanism and reel, such as disclosed in the aforesaid U.S. Pat. No. 5,898,472, which is hereby incorporated herein by reference.

The light includes a housing 26 having a forward surface 28 and a rear surface 30. The housing 26 comprises sheet material 32 composed of rigid plastic or other suitable material, preferably non-conductive to accommodate the circuitry hereinafter described, rigidly forming a forward wall 34, a top wall 36, a bottom wall 38, a right side wall 40, and a left side wall 42. The front wall is formed by member 44, which will be described in greater detail hereinafter. These walls define a cavity, illustrated at 46, in which various light components, as described hereinafter, are contained or housed.

The front wall 34 has a generally rectangular (or otherwise suitably shaped) opening, illustrated at 48, therein. The wall 34 has an inwardly offset lip or flange 50 along one edge, i.e., as shown, the edge corresponding to the right side of the opening 48, and a generally rectangular rigid member 51 is mounted in the opening 48 so that an edge thereof rests on the lip 50 so that the forward surface of the member 51 is flush with the forward surface of the front wall 26. The opposite edge of the member 51 has an inwardly offset lip or flange 54 which nests under the respective front wall edge, and the member 51 is suitably attached to the lip 50 such as by a pair of screws 56. The member has a generally rectangular opening, illustrated at 53, therein. A conventional reflector/bulb holder 58 including a suitable conventional lens 52, composed for example of plastic, is suitably positioned in the cavity 46 in back of the opening 53 (to be generally flush with the front wall) to allow passage of light 18 through the opening 53, the edges of the lens 52 being suitably mounted to the edges of the member 51 (inwardly of lip 54) by means such as, for example, an adhesive. A conventional flashlight-type bulb 60 is suitably mounted centrally of the reflector 58 such as by a threaded portion 62 which is threadedly received in reflector aperture 64. A pair of suitable flashlight-type batteries 66 are received within the cavity 46 on opposite sides of the bulb 60. The batteries 66 may, for example, be no. 950 size D type.

The side walls 40 and 42 extend rearwardly for a short distance beyond the cavity 46, and a generally cylindrical (or otherwise suitably shaped) cut-out 71 is provided in each side wall 40 and 42, the cut-out extending through the rear edge of the respective side wall and spaced from each of the other edges thereof to provide an opening through which the respective battery 66 can be inserted and removed, as seen in FIG. 9. Suitable springs, illustrated at 79, are desirably attached to the inner surface of the respective door to apply pressure to the batteries 66 respectively so that the batteries are secured against shaking when in the cavity 46. The cut-out 71 is closed by a door or closure plate 73 which has an inwardly offset forward lip or flange 75 to be received inwardly of the corresponding edge portion 77 of the respective wall 40 and 42 so that the outer surface of the door 73 is flush with the outer surface of the respective wall 40 and 42, as seen in FIG. B. A forward end portion of a rigid plate 72 is received inwardly of the respective door 73, and the plate 72 is secured to (embedded in) member 44 as hereinafter discussed. Each door 73 is suitably attached to the respective plate 72 by a finger screw 74 received in an aperture 70 in a rear edge portion 68 of the door 73 and threadedly received in a threaded aperture 76 in a forward edge portion of the plate 72. The plate 72 extends rearwardly beyond the respective side wall and terminates short of the respective rearward-most surface 78 of the member 44 so that the member 44 extends rearwardly beyond the respective plate 72. The lateral walls 80 of the member 44 are flush with respect to the doors 73 and the side walls 40 and 42 respectively whereby the plates 72 are partially embedded in the material of the member 44 to provide a secure position thereof for secure attachment of the doors 73. Each plate 72 has an enlarged rearward end portion 82 which extends laterally outwardly from the member 44, the enlarged portion 82 having suitable structure for receiving an end of the strap for adjustably attaching the light 20 to the person's head 22, in accordance with principles commonly known to those of ordinary skill in the art to which the present invention pertains. A suitable conventional on-off switch 84 is suitably mounted so that it is suitably secured to one of the plates 72 (i.e., as shown, the right plate), in accordance with principles commonly known to those of ordinary skill in the art to which the present invention pertains. One side of the switch 84 is electrically connected to the bulb 60 by line 86. The bulb is also electrically connected to the negative terminal of one of the batteries 66 by line 88. The positive terminal of that battery 66 is electrically connected to the negative terminal of the other battery 66 by line 90 whereby the batteries are connected in the circuit in series. Finally, the positive terminal of this other battery 66 is electrically connected to the switch 84 by line 92 thereby completing the circuit for supplying electricity to the bulb 60 for lighting by turning the switch 84 on. It should however be understood that the circuitry may be embodied otherwise. For example, the circuitry may alternatively be of a type which includes a ground to the housing sheet material 32, which accordingly is a conductive material.

Figure 7:
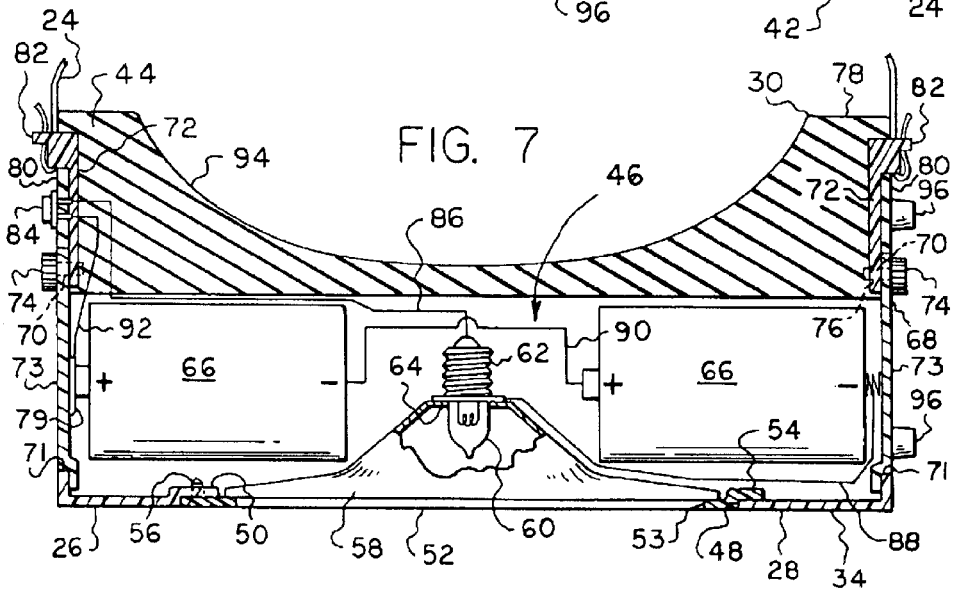
FIG. 7 is a section view taken along lines 7—7 of FIG. 4, with the strap broken away.

In order to accurately and easily and comfortably mount the light assembly 20 to the user's forehead so that the light 18 is aimed in the direction of sight, in accordance with the present invention, the housing member 44 is composed of an elastomeric material such as, for example, foam rubber, which has suitable softness to comfortably conform to the person's forehead. The elastomeric material is suitably molded about the rigid plates 72 as illustrated in FIG. 7 to hold the plates 72 securely in place and so that the plates provide a secure means of attachment of the member 44. The molded elastomeric material may extend forwardly beyond the rigid plates 72 a distance of, for example, about ½ inch. The member 44 has a symmetrical concave rearward surface 94 for engaging the typical forehead of the user 22, as illustrated in FIG. 3. For example, for a typical adult, the concave surface 94 may have a width of about 6 inches and a depth of about 2 inches. The light assembly 20 may be provided in more than one size of the concave surface 94. The overall width of the light apparatus 20 may, for example, be about 6¾ inches, the lens width may, for example, be about 4 inches, and the overall light apparatus depth (front to back) may, for example, be about 3½ inches. The above dimensions are for exemplary purposes only and not for purposes of limitation.

Figure 6:
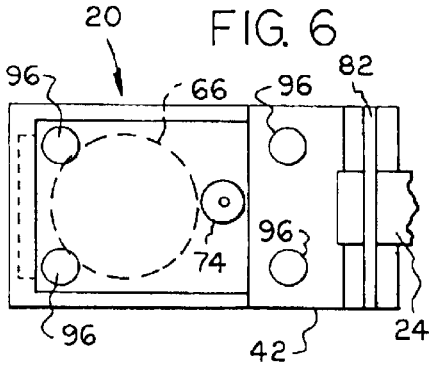
FIG. 6 is a left side elevation view thereof, with the strap broken away.

In order to provide a stand, i.e., a means for setting the light assembly 20 down without damage to the lens or switch, while allowing access to the switch, feet members or legs 96 are suitably attached to the side of the housing 26 which does not contain the switch. Thus, the feet 96 are shown on the left side wall 42. Feet 96 may be composed of hard rubber other suitable material adhesively or otherwise suitably attached to the side wall 42. For example, 4 such feet 96 may be provided at the four corners respectively of the side wall 42, as shown in FIG. 6.

Thus, the light assembly 20 may be easily and quickly mounted on a person's head 22 by receiving the forehead in the symmetrical concave surface 94, which accordingly properly centers the light 20 to aim in the direction in which the user sees, and adjusting the straps 24 as necessary. The elastomeric material of the member 44 allows a snug and comfortable fit when the straps are suitably tightened as necessary.

It should be understood that, while the present invention has been described in detail herein, the invention can be embodied otherwise without departing from the principles thereof, and such other embodiments are meant to come within the scope of the present invention as defined by the appended claims.

What is claimed is:

1. A light apparatus comprising a housing having a rigid wall structure which at least partially defines a cavity, a member attached to said rigid wall structure and at least a portion of which is composed of elastomeric material having a rear concave surface shaped for elastomerically conforming to a person's forehead, a device for attaching said housing to the person's head with said rear surface disposed in conforming relation to the person's forehead, at least one lens, at least one light bulb disposed in said housing and electrically connectable to at least one battery in said housing to emit light through said lens, and said lens and said light bulb disposed for directing light forwardly of said housing and generally along the line of sight of the person.

2. A light apparatus according to claim 1 further comprising at least two batteries positioned on opposite sides of said light bulb and electrically connectable thereto.

3. A light apparatus according to claim 2 further comprising a plurality of legs on at least one side of said housing for providing support for setting the light apparatus down.

4. A light apparatus according to claim 1 further comprising a plurality of legs on at least one side of said housing for providing support for setting the light apparatus down.

5. A light apparatus comprising a housing at least a portion of which is composed of elastomeric material having a rear concave surface shaped for conforming to a person's forehead to allow elastomeric conformity of said rear surface to the person's forehead, a device for attaching said housing to the person's head with said rear surface disposed in conforming relation to the person's forehead, at least one lens, at least one light bulb disposed in said housing and electrically connectable to at least one battery to emit light through said lens, and said lens and said light bulb disposed for directing light forwardly of said housing and generally along the line of sight of the person, the light apparatus further comprising a plurality of legs on at least one side of said housing for providing support for setting the light apparatus down.

6. A light apparatus comprising a housing having a rigid wall structure which at least partially defines a cavity, a member attached to said rigid wall structure and at least a portion of which is composed of elastomeric material having a rear concave surface shaped for elastomerically conforming to a person's forehead, means for attaching said housing to the person's head with said rear surface disposed in conforming relation to the person's forehead, at least one lens, at least one light bulb disposed in said housing to emit light through said lens, said lens and said light bulb disposed for directing light forwardly of said housing and generally along the line of sight of the person, and means for energizing, in said housing, said light bulb to emit light.

7. A light apparatus according to claim 6 wherein said energizing means comprises at least two batteries positioned on opposite sides of said light bulb.

8. A light apparatus according to claim 7 further comprising a plurality of legs on at least one side of said housing for providing support for setting the light apparatus down.

9. A light apparatus according to claim 6 further comprising a plurality of legs on at least one side of said housing for providing support for setting the light apparatus down.

10. A light apparatus comprising a housing at least a portion of which is composed of elastomeric material having a rear concave surface shamed for conforming to a person's forehead to allow elastomeric conformity of said rear surface to the person's forehead, means for attaching said housing to the person's head with said rear surface disposed in conforming relation to the person's forehead, at least one lens, at least one light bulb disposed in said housing to emit light through said lens, said lens and said light bulb disposed for directing light forwardly of said housing and generally along the line of sight of the person, and means for energizing said light bulb to emit light, the light apparatus further comprising a plurality of legs on at least one side of said housing for providing support for setting the light apparatus down.

* * * * *

UNITED STATES PATENT AND TRADEMARK OFFICE

CERTIFICATE OF CORRECTION

PATENT NO. : 6,848,804 B2
DATED : February 1, 2005
INVENTOR(S) : Webber

It is certified that error appears in the above-identified patent and that said Letters Patent is hereby corrected as shown below:

Column 6,
Line 16, "shamed" should read -- shaped --.

Signed and Sealed this

Third Day of May, 2005

JON W. DUDAS
*Director of the United States Patent and Trademark Office*